US009926057B1

(12) United States Patent
Brodtke

(10) Patent No.: US 9,926,057 B1
(45) Date of Patent: Mar. 27, 2018

(54) HYDRO SYSTEM SCREW PUMP AND FORMULA

(71) Applicant: Gary Louis Brodtke, Menasha, WI (US)

(72) Inventor: Gary Louis Brodtke, Menasha, WI (US)

( * ) Notice: Subject to any disclaimer, the term of this patent is extended or adjusted under 35 U.S.C. 154(b) by 0 days.

(21) Appl. No.: 15/821,514

(22) Filed: Nov. 22, 2017

Related U.S. Application Data

(63) Continuation-in-part of application No. 14/964,456, filed on Dec. 9, 2015, which is a continuation-in-part of application No. 14/729,031, filed on Jun. 2, 2015, now abandoned, application No. 15/821,514, which is a continuation-in-part of application No. 15/407,199, filed on Jan. 16, 2017.

(60) Provisional application No. 62/006,690, filed on Jun. 2, 2014.

(51) Int. Cl.
*B63H 1/14* (2006.01)
*B63H 1/12* (2006.01)
*B63H 23/32* (2006.01)

(52) U.S. Cl.
CPC ..... *B63H 1/14* (2013.01); *B63H 2001/122* (2013.01); *B63H 2023/322* (2013.01)

(58) Field of Classification Search
CPC ..... B63H 2011/081; B63H 2001/122; B63H 5/14; B63H 5/16; B63H 2023/322; B63H 2023/327
USPC ..... 440/48, 49
See application file for complete search history.

(56) References Cited

U.S. PATENT DOCUMENTS 854,112 A * 5/1907 Shaw ..... B63H 1/38 440/48
1,545,723 A * 7/1925 Zwiesler ..... B63H 25/46 440/48
2,320,451 A * 6/1943 Akins ..... B63H 5/14 440/48
2,402,197 A * 6/1946 Kincannon ..... B63H 21/28 416/169 R
2,413,227 A * 12/1946 Hanson ..... B63H 5/16 440/48
2,941,495 A * 6/1960 Goldman ..... B63H 25/42 440/48
3,369,514 A * 2/1968 Cockerell ..... B60V 1/043 114/67 A
3,441,088 A * 4/1969 Levy ..... B63H 5/14 415/74
4,986,775 A * 1/1991 Wantz ..... B63H 21/28 384/615
5,462,463 A * 10/1995 Meisenburg ..... B63H 5/10 440/80

(Continued)

FOREIGN PATENT DOCUMENTS

GB 2294914 A * 5/1996 ..... B63H 5/10

*Primary Examiner* — Ruth Ilan

(57) ABSTRACT

A system where a shaft runs through a center of a hydro screw helical gear main bearing. The helical gear positioned at approximately the end of the horizontal shaft and connects to the vertical power shaft and mating helical gear. Two main and two truss (shoe type) bearings position the screw/auger. There is on the hydro shaft a pressure seal in the Power Keel. The pitch angle is one turn (RPM) to 7.5 feet of travel with a four feet wide screw built into the blades-flukes off the screw/auger. The bearings are 12,000 RPM capable.

17 Claims, 14 Drawing Sheets

(56) References Cited

U.S. PATENT DOCUMENTS

| | | | | |
|---|---|---|---|---|
| 5,597,334 | A * | 1/1997 | Ogino | B63H 5/10<br>184/6.12 |
| 2004/0092177 | A1* | 5/2004 | Creighton | B63B 3/40<br>440/82 |
| 2005/0075015 | A1* | 4/2005 | Kettelson | B63H 1/12<br>440/48 |

* cited by examiner

HYDRO SYSTEM SCREW PUMP AND FORMULA

CROSS-REFERENCE TO RELATED APPLICATIONS

The present continuation patent application claims priority benefit of the U.S. continuation in part patent application Ser. No. 15/407,199 entitled "HYDRO SYSTEM SCREW PUMP AND FORMULA" filed 16 Jan. 2017, and further claims U.S. nonprovisional patent application Ser. No. 14/964,456 entitled "HYDRO-SCREW PUMP AND AN ASSEMBLY FORMULA FOR THE SAME" filed 9 Dec. 2015 and further claims U.S. nonprovisional patent application Ser. No. 14/729,031 entitled "HYDRO-SCREW PUMP AND AN ASSEMBLY FORMULA FOR THE SAME" filed 2 Jun. 2015, and further claims priority to U.S. provisional application for patent Ser. No. 62/006,690 filed 2 Jun. 2014 under 35 U.S.C. 119(e). The contents of these related patent applications are incorporated herein by reference for all purposes to the extent that such subject matter is not inconsistent herewith or limiting hereof.

RELATED CO-PENDING U.S. PATENT APPLICATIONS

Not applicable.

INCORPORATION BY REFERENCE OF SEQUENCE LISTING PROVIDED AS A TEXT FILE

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

BACKGROUND OF THE RELEVANT PRIOR ART

One or more embodiments of the invention generally relate to a water vehicle propulsion system. More particularly, certain embodiments of the invention relates to a hydro-screw propulsion system to propel the water transportation vehicles at high speed.

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon. A propulsion is a mechanism to move a vehicle in water or air or space. A marine propulsion is the mechanism or system used to generate thrust to move a ship or boat across water. While paddles and sails are still used on some smaller boats, most modern ships are propelled by mechanical systems consisting of an electric motor or engine turning a propeller, or less frequently, in pump-jets, an impeller.

By way of educational background, an aspect of the related technology generally useful to be aware of is that a current marine propulsion set comprises at least one power keel that is mechanically connected to a power shaft; a propeller that is situated at the shaft end of the power keel and that has at least two blades; and an arrangement of at least two flow-directing fins that are fastened to the screw. This arrangement of fins forms a ring that is substantially perpendicular to the longitudinal axis of the keel, said ring (shrouds) lying with in this situated between the central portion of said support strut and the propeller. The propulsion set further comprises a shroud that surrounds, at least in part, the propeller and said ring. Each of said blades presents an end with an edge coming flush with the inside wall of the shroud so that the propeller constitutes the rotor of a screw pump. Further, the boats having an outboard truss bearing may be prone to leaking lubricant. The leakage is mostly due to imbalances or gradient created from an internal pressure to an external pressure. Thus, in some cases the bearings get flooded with pressurized water coming from the conically shaped shrouds.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
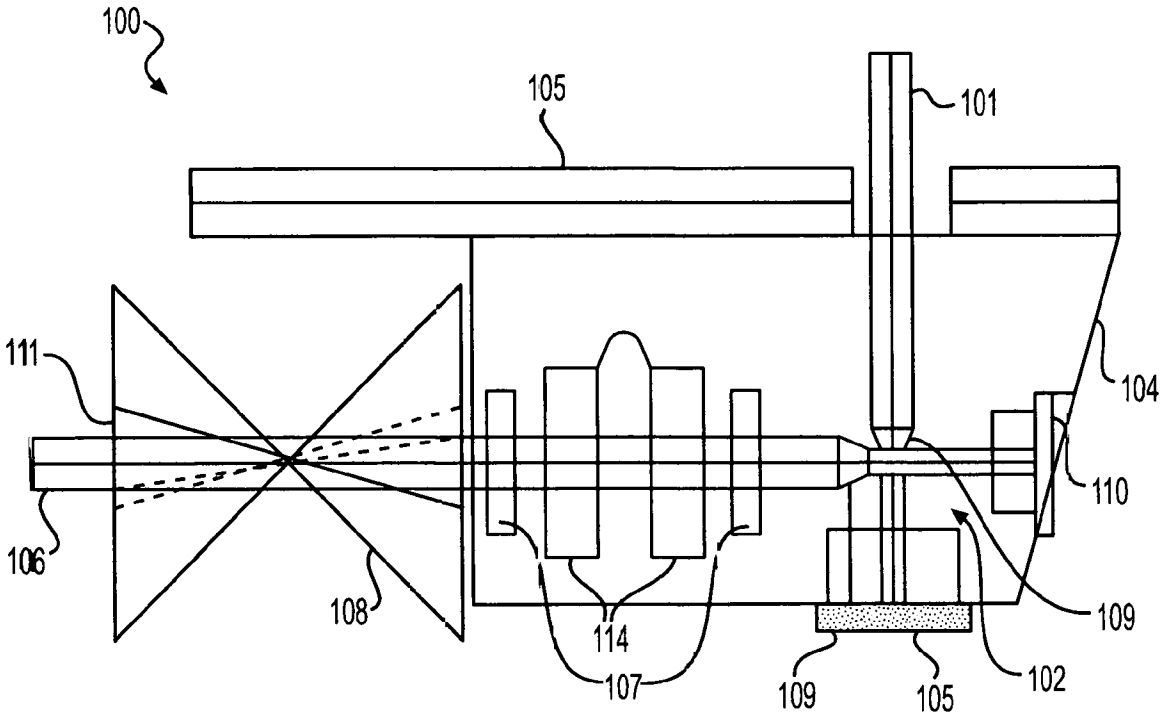
FIG. 1 illustrates a side view of an assembly of the hydro-pump, according to an embodiment herein.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, it is well settle law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See Energy Absorption Sys., Inc. v. Roadway Safety Servs., Inc., Civ. App. 96-1264, slip op. at 10 (Fed. Cir. Jul. 3, 1997) (unpublished) Hybridtech v. Monoclonal Antibodies, Inc., 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See Seattle Box Co. v. Industrial Crating & Packing, Inc., 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. Deering Precision Instruments, L.L.C. v. Vector Distribution Sys., Inc., 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forwardmost point of the upper or outsole and the rearwardmost point of the upper or outsole.

Similarly, the term 'substantially' is well recognized in case law to have the dual ordinary meaning of connoting a term of approximation or a term of magnitude. See Dana Corp. v. American Axle & Manufacturing, Inc., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See Cordis Corp. v. Medtronic AVE Inc., 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also Deering Precision Instruments, LLC v. Vector Distribution Sys., Inc., 347 F.3d 1314, 1322 (Fed. Cir. 2003); Epcon Gas Sys., Inc. v. Bauer Compressors, Inc., 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, Liquid Dynamics Corp. v. Vaughan Co., 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In Cordis Corp. v. Medtronic AVE, Inc., 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In Anchor Wall Systems v. Rockwood Retaining Walls, Inc., 340 F.3d 1298, 1311 (Fed. Cir. 2003)" Id. at 1311. Similarly, the plain language of Claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see Deering Precision Instruments, L.L.C. v. Vector Distrib. Sys., Inc., 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., Epcon Gas Sys., Inc. v. Bauer Compressors, Inc., 279 F.3d 1022 (Fed. Cir. 2002) (construing the terms "substantially constant" and "substantially below"); Zodiac Pool Care, Inc. v. Hoffinger Indus., Inc., 206 F.3d 1408 (Fed. Cir. 2000) (construing the term "substantially inward"); York Prods., Inc. v. Cent. Tractor Farm & Family Ctr., 99 F.3d 1568 (Fed. Cir. 1996) (construing the term "substantially the entire height thereof"); Tex. Instruments Inc. v. Cypress Semiconductor Corp., 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see AK Steel Corp. v. Sollac, 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by Pall Corp. v. Micron Separations, Inc., 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see Verve LLC v. Crane Cams Inc., 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. § 112, and indeed may be necessary in order to provide the inventor with the benefit of his invention. In Andrew Corp. v. Gabriel Elecs. Inc., 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in Ecolab Inc. v. Envirochem, Inc., 264 F.3d 1358, 1367, 60 USPQ2d 1173, 1179 (Fed. Cir. 2001) that "like the term 'about,' the term 'substantially' is a descriptive term commonly used in patent claims to avoid a strict numerical boundary to the specified parameter," see Ecolab Inc. v. Envirochem Inc., 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see Pall Corp. v. Micron Seps., 66 F.3d 1211, 1217, 36 USPQ2d 1225, 1229 (Fed. Cir. 1995); see, e.g., Andrew Corp. v. Gabriel Elecs. Inc., 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will be described in detail below with reference to embodiments thereof as illustrated in the accompanying drawings.

References to a "device," an "apparatus," a "system," etc., in the preamble of a claim should be construed broadly to mean "any structure meeting the claim terms" exempt for any specific structure(s)/type(s) that has/(have) been explicitly disavowed or excluded or admitted/implied as prior art in the present specification or incapable of enabling an object/aspect/goal of the invention. Furthermore, where the present specification discloses an object, aspect, function, goal, result, or advantage of the invention that a specific prior art structure and/or method step is similarly capable of performing yet in a very different way, the present invention disclosure is intended to and shall also implicitly include and cover additional corresponding alternative embodiments that are otherwise identical to that explicitly disclosed except that they exclude such prior art structure(s)/step(s), and shall accordingly be deemed as providing sufficient disclosure to support a corresponding negative limitation in a claim claiming such alternative embodiment(s), which exclude such very different prior art structure(s)/step(s) way(s).

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" includes the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, is generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of, or interaction with, some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising." This term is open-ended. As used in the appended claims, this term does not foreclose additional structure or steps. Consider a claim that recites: "A memory controller comprising a system cache . . . " Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" and "consisting of" limits the scope of a claim to the specified elements or method steps, plus those that do not materially affect the basis and novel characteristic(s) of the claimed subject matter (see Norian Corp. v Stryker Corp., 363 F.3d 1321, 1331-32, 70 USPQ2d 1508, Fed. Cir. 2004). Moreover, for any claim of the present invention which claims an embodiment "consisting essentially of" or "consisting of" a certain set of elements of any herein described embodiment it shall be understood as obvious by those skilled in the art that the present invention also covers all possible varying scope variants of any described embodiment(s) that are each exclusively (i.e., "consisting essentially of") functional subsets or functional combination thereof such that each of these plurality of exclusive varying scope variants each consists essentially of any functional subset(s) and/or functional combination(s) of any set of elements of any described embodiment(s) to the exclusion of any others not set forth therein. That is, it is contemplated that it will be obvious to those skilled how to create a multiplicity of alternate embodiments of the present invention that simply consisting essentially of a certain functional combination of elements of any described embodiment(s) to the exclusion of any others not set forth therein, and the invention thus covers all such exclusive embodiments as if they were each described herein.

With respect to the terms "comprising," "consisting of" and "consisting essentially of" where one of these three terms is used herein, the presently disclosed and claimed subject matter may include the use of either of the other two terms. Thus in some embodiments not otherwise explicitly recited, any instance of "comprising" may be replaced by "consisting of" or, alternatively, by "consisting essentially of", and thus, for the purposes of claim support and construction for "consisting of" format claims, such replacements operate to create yet other alternative embodiments "consisting essentially of" only the elements recited in the original "comprising" embodiment to the exclusion of all other elements.

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

An embodiment of the present invention may provide a propulsion device assembly to propel a various size of water transportation vehicles at high speed.

Some embodiments may provide a propulsion screw with improved pitch angle to provide high torque to propel a ship from a harbour or a dockyard in a small interval of time.

Some embodiments may provide a propulsion screw with a generic assembly to be utilized in a plurality of a ships ranging from a sail boat to a naval ship.

Some of the embodiments described herein provide a hydro-propulsion screw with a high torque output for a transportation vehicle comprising a power shaft and a horizontal drive train. The power shaft is a vertical shaft connected to a power source of the vehicle. The hydro-propulsion screw and a power keel may be attached to a bottom body of the water transportation vehicle. The power shaft is attached to a bottom of the keel through a bearing. The horizontal drive train further comprises a horizontal shaft, at-least two truss bearings and at-least one hydro screw. The horizontal shaft is connected to the power shaft through a set of helical gears. The horizontal shaft is connected to a body of the keel. The truss bearings bolted back to back together and are connected to the horizontal shaft both housed in the keel. The truss bearings are further housed in a frame assembly. The hydro screw is connected to the horizontal shaft outside the keel at a same axis. The hydro screw comprises two screw troughs. The combination of the hydro screw and screw troughs further comprises a plurality of hydro fins fitted with one or more conically shaped shrouds.

According to an embodiment herein, the power shaft rotates the horizontal shaft resulting in the rotation of the hydro-screw. The rotation of the hydro-screw provides a flow of pressurized water along the horizontal shaft. The hydro-screw reduces pressure on a stern end of the keel and greatly reduces, if not disallows, cavitation. That is, a ship equipped with such an embodiment may have greatly reduced, if not eliminated, cavitation, maximum power to the screw, and greatly reduced, if not nearly eliminated, vibration. A significant factor for such properties is the hydro systems screw. In the present embodiment the screw has a steeper pitch angle than current propulsion drive systems and has more surface area and a greater propeller/screw diameter than any conventional designs. In addition, with all the components inside the power keel, the hydro screw is relatively quiet and powerful in terms of providing linear travel per RPM/pitch angle.

According to an embodiment herein, the power shaft and the horizontal shaft are turned down to at least 3.25 inches at a connection point to the helical gears that are connected in 1:1 ratio.

According to an embodiment herein, the power shaft and the horizontal shaft have inspection covers having diameters of at least 2 inches larger than the helical gears diameter and are used for checking a perfect meshing of the helical gears.

According to an embodiment herein, the hydro screw is interconnected with shrouds, According to an embodiment herein, the hydro screw is annealed for at-least one time and dynamically balanced before installation of the horizontal shaft.

According to an embodiment herein, the horizontal shaft has an outer diameter of at least 4.25 feet.

According to an embodiment herein, a bore size of the truss bearing is at least 4.25 inches.

According to an embodiment herein, a lubricant is sprayed on the all bearings at all speeds.

According to an embodiment herein, a clearance of the water transportation vehicle at the keel is in the range of ⅝ inch to 1.0 inch.

According to an embodiment herein, a diameter of the hydro screw is within a one to two lengths of a pitch angle of the hydro screw.

According to an embodiment herein, the outer diameter of the hydro screw pump tube has a tolerance range of plus or minus 0.002 inches. The outer diameter of the hydro screw has a tolerance of minus 0.0005 to minus 0.0015 inches.

FIG. 1. illustrates a side view of an assembly of the hydro-screw pump, according to an embodiment herein. With respect to FIG. 1, the hydro-propulsion screw 100 comprises a power shaft 101 and a horizontal drive train 102. The power shaft 101 is a vertical shaft connected to a power source of the vehicle. The hydro-propulsion screw 100 and a keel 104 are attached to a bottom body 103 of the water transportation vehicle. The power shaft 101 is attached to a bottom of the keel 104 through a bearing 105. The keel 104 is primarily made of cast steel. The horizontal drive train 102 further comprises a horizontal shaft 106, at-least two bearings & two truss bearings 107 and at-least two hydro screws 108. The horizontal shaft 106 is orthogonally connected to the power shaft 101 through a set of helical gears 109. The horizontal shaft 106 is connected to a body of the keel 104 through a bearing 110. The truss bearings 107 are connected to the horizontal shaft 106 both housed in the keel 104. The truss bearings 1.07 are further housed in a frame assembly. The two hydro screws 108 are connected to the horizontal shaft 106 outside the keel 104 at a same axis. Each hydro screw 108 comprises a screw trough 111. The combination of the at-least two hydro screws 108 further comprises a plurality of hydro fins fitted with one or more conically shaped shrouds. The shrouds are of a truncated cone shape with a larger and a smaller circumference. The smaller circumferences of the shrouds arc towards the stern of the ship. The stern is further attached with a V-shaped bracket which creates a Venturi effect to force the water in an outward direction.

Figure 2:
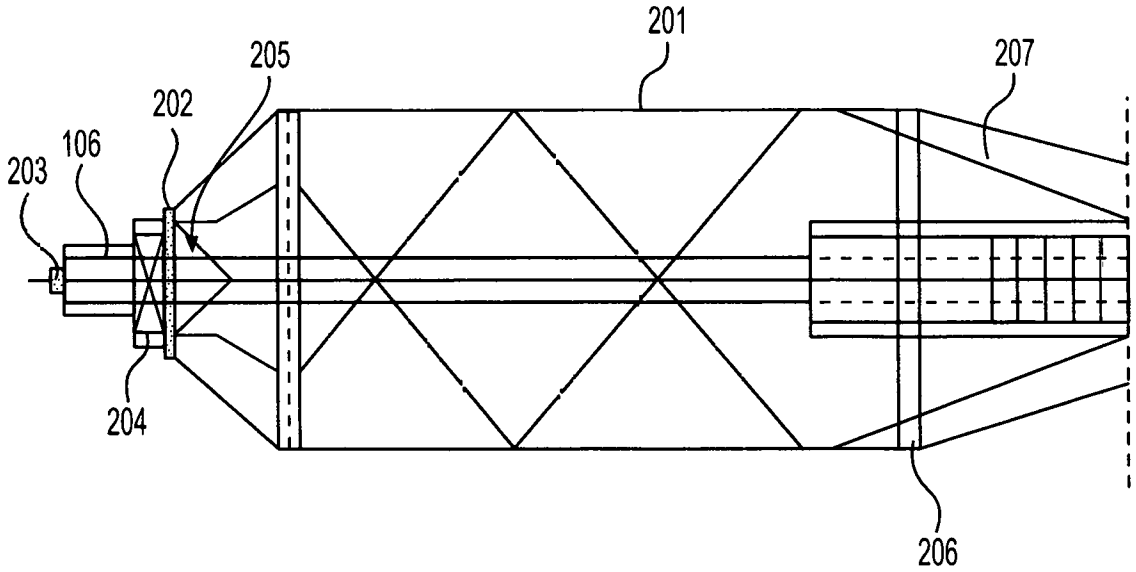
FIG. 2 illustrates a side view of the assembly of the hydro-screw pump and the keel, according to an embodiment herein.

FIG. 2 illustrates a side view of the assembly of the hydro-screw pump, according to an embodiment herein. With respect to FIG. 2, the horizontal shaft 106 passes through the center of the pump tube 201. A top portion of the horizontal shaft 106 is held into a bore bearing 204 with an OD size 5.750 inches through a washer 203 having an outer diameter of 7.75 inches. The washer 203 is held to the bore bearing 204 through at-least 3 bolts positioned in an equilateral triangular manner. A steel cone 205 with 7 inch diameter by 7 inch height is installed in the pump tube 201 acting as a water deflector in an outward direction. The pump tube 201 is fitted over a 3 inch flange 206. The diameter of the hydro screw is equal to the pitch angle or in a range of equal and double the pitch angle of the hydro screw.

Figure 3:
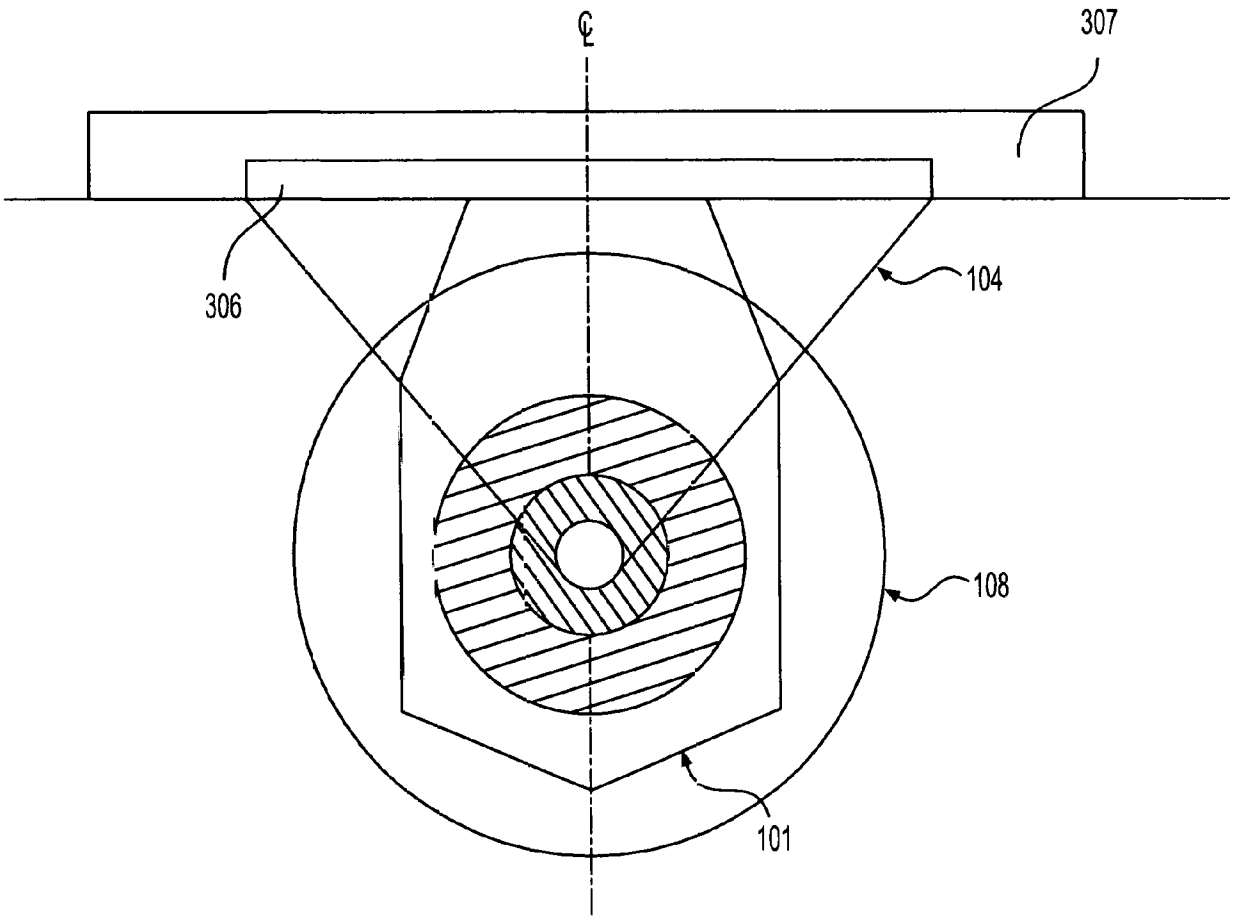
FIG. 3 illustrates an end view of the hydro-screw pump and the keel from the stern of the water transportation vehicle, according to an embodiment herein.

FIG. 3 illustrates an end view of the hydro-screw and the keel from the stern of the water transportation vehicle, according to an embodiment herein. With respect to FIG. 3, the keel. 104 houses the horizontal drive and also supports the hydro screw 108 and the truss bearings through the horizontal shaft 106. There is a V bracket at the stern end of ships which eliminates screw/auger sag and vibration and eliminates cavitation.

The present hydro propulsion screw assembly provides a high speed solution to the water transportation vehicle needs ranging from a boat to an aircraft carrier, The assembly design of the present hydro propulsion screw and pump is generic in nature and allows for easy manufacture and installation for a plurality of range of water transportation vehicles, which reduces a manufacturing cost.

Figure 5:
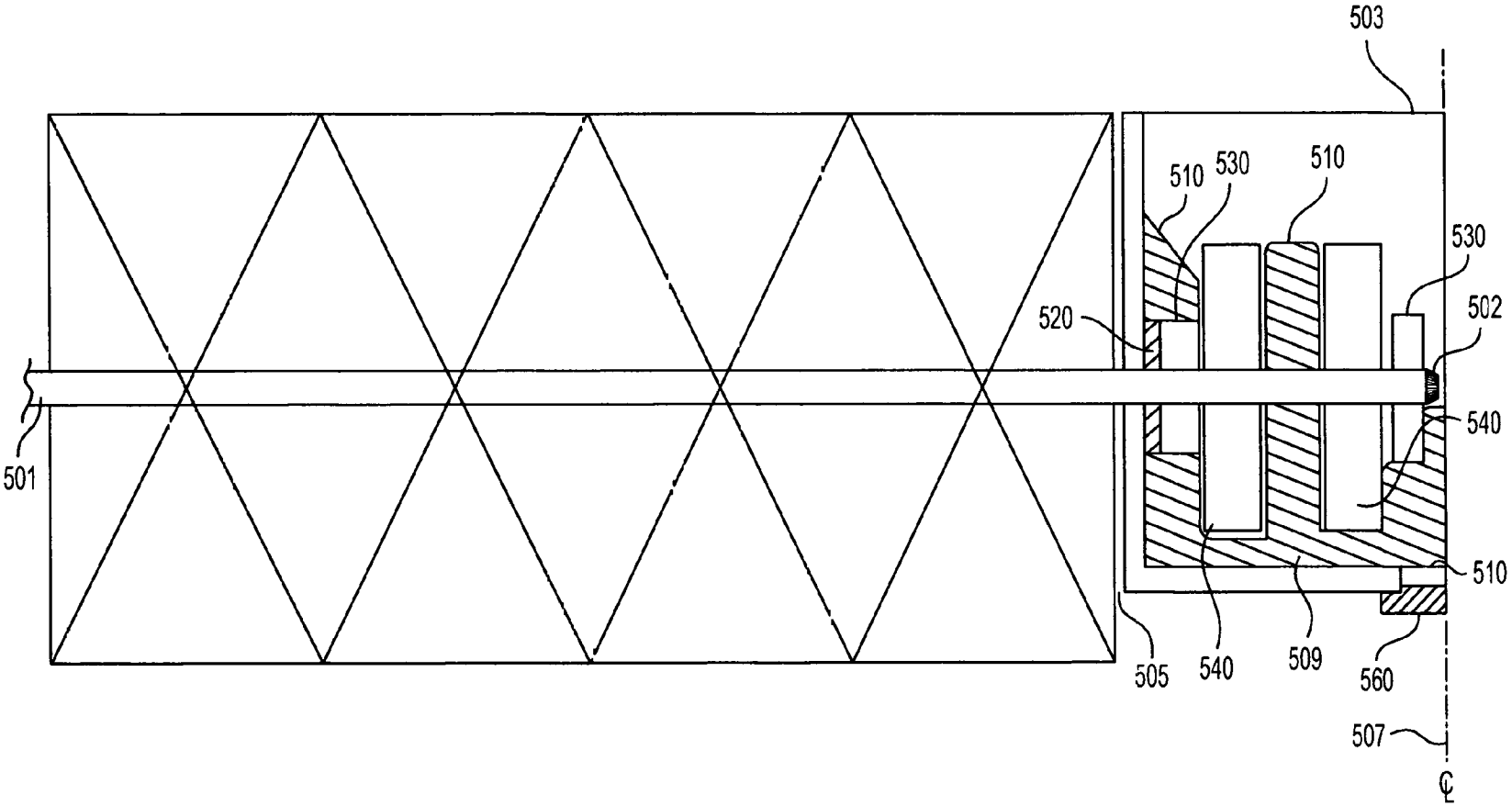
FIG. 5 illustrates a side view of an exemplary hydro-screw long shaft assembly, according to an embodiment of the present invention.

FIG. 5 illustrates a side view of an exemplary hydro-screw assembly, according to an embodiment of the present invention. In the present embodiment a horizontal shaft 501 may be connected to the power shaft of an engine through a. set of helical gears 502 (horizontal and vertical) near a machined down shoulder end of horizontal shaft 501. Helical gears 502 may be machined into shaft 501 and geared in a 1:1 ratio to each other. A main pressure seal 520 may be designed to take high pressure on both the water (sea) side and the power keel (lubricant) side. Main bearings 530 may be housed inside a power keel 503 and typically control the rotation and position of shaft 501. Two truss bearings 540 may be mounted back to back to control the float/end play of shaft 501. By mounting the two truss bearings 540 back to back in this area close to helical gears 502, the position of shaft 501 is held allowing helical gears 502 to maintain the meshing of their teeth. In the present embodiment, there may be a 1 inch gap 505 between the end of power keel 503 and the hydro screw creating a pressure relief valve area of the screw. When the water pressure builds up to forces unable for seal 520 and adjacent bearing 530 to tolerate, gap 505 will enable water to flow around the end of power keel 503 and out from the hydro screw. A bearing retainer/inspection cover 560 may be removed to check the tolerances of helical gears 502. By adding or subtracting shims (one piece/not cut) the correct gear mesh tolerances can be achieved. There may also be sensor packages around the ends of the power shaft, horizontal shaft 501, and power, keel 503 to monitor imbalance, vibration, beat, and sound within power keel 503. These sensor packages can be removed or replaced—(Inspection cover 560 or other inspection covers). A vertical center line 507 may be used to position the two shafts at assembly and when over-hauling the machine. A wire may be used to mark the exact center. A V-shaped bracket (not shown) may be installed at the end of horizontal shaft 501 to help prevent the hydro screw from sagging and causing vibration. Truss bearings 540 may be mounted to a hard metal machined portion 509 of power keel 503 below and above the horizontal joint. Additional hard machined surfaces 510 within power keel 503 may be used for mounting and holding equipment.

Figure 6:
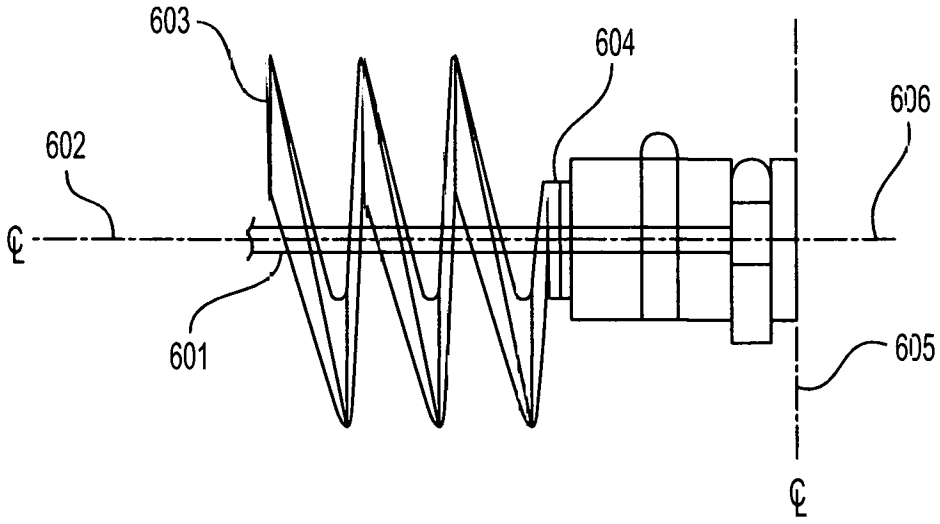
FIG. 6 illustrates a side view of an exemplary corkscrew shaped pump of the hydro screw according to an embodiment of the present invention.

FIG. 6 illustrates a side view of an exemplary corkscrew shaped pump of the hydro screw according to an embodiment of the present invention. In the present embodiment, a hydro trough 601 may be built around a horizontal shaft 602 to strengthen shaft 602 and the blades of an auger type screw 603. Hydro trough 601 may be hollow from stern to stern. Other than strengthening the blades of screw 603 and shaft 602, hydro trough 601 may also relieve the pressure from a stern seal 604 of screw 603 at the stern end of the power keel. The more Revolutions Per Minute (RPM) the ship puts out, the more pressure is exerted on the stern seal 604 and is relieved from the stern seal 604 by hydro trough 601. A vertical center line 605 may be used to set up machining and assembly for the building of a power keel. The present embodiment shows the centers of the components in their alignment before/during machining and assembly (helical gear off set). Having an accurate vertical center line 605 may make it possible to transfer the line to the hull of a ship and the center of the (diesel engine)/power plant's vertical power shaft (gear box). A horizontal center line 606 may be used to set the final alignment of the hydro-screw assembly including, without limitation, bearings and seals in the power keel.

Figure 7:
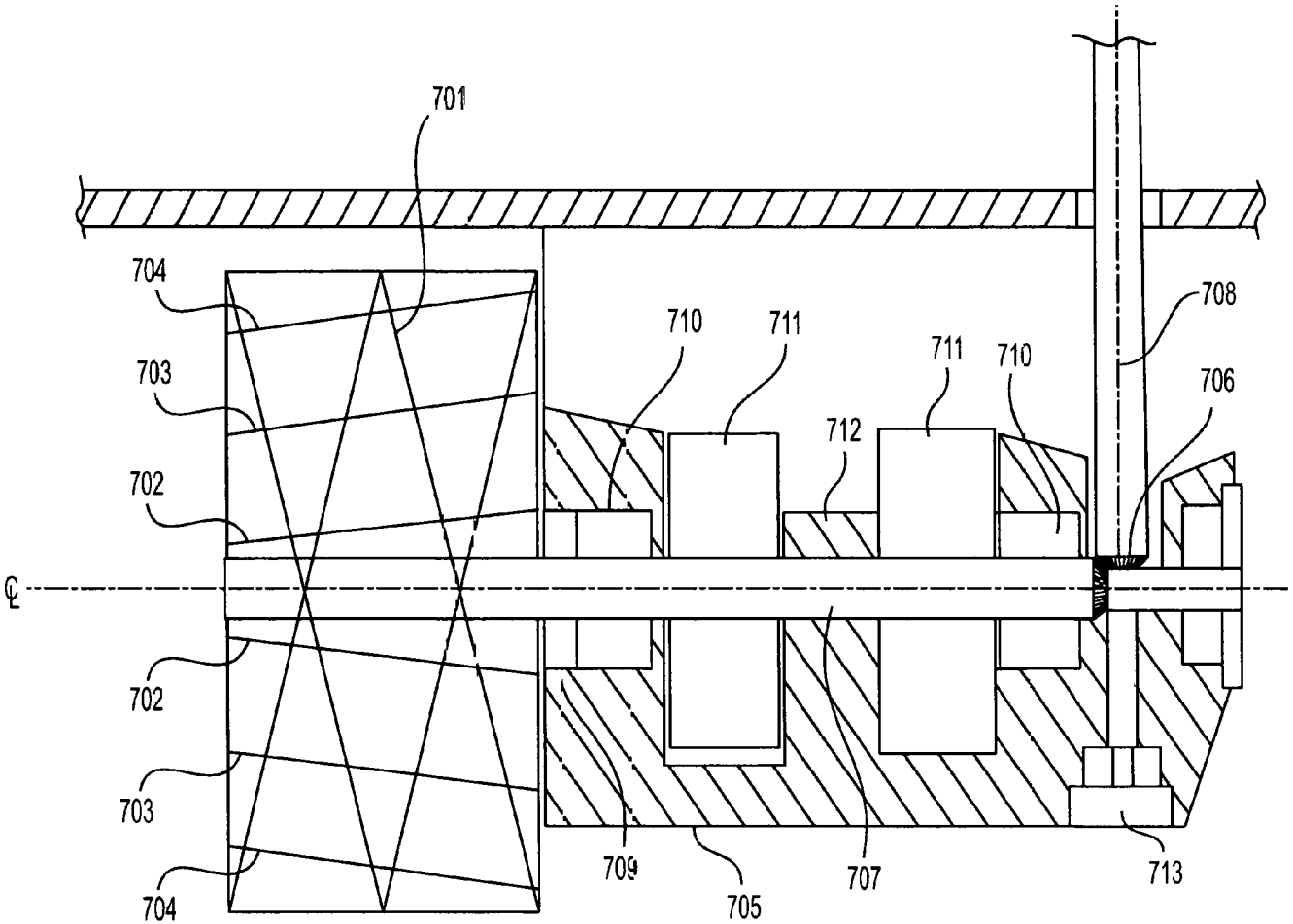
FIG. 7 illustrates a side view of the hydro screw drive train and shrouds, according to an embodiment of the present invention.

FIG. 7 illustrates a side view of the hydro screw drive train and shrouds, according to an embodiment of the present invention. In more basic embodiments, the hydro drive screws may have only one set of shrouds. However, there is room for more shrouds within the blades of a hydro system auger type screw. In the present embodiment, an auger type screw 701 comprises three shrouds 702, 703, and 704. Shrouds 702, 703, and 704 not only strengthen screw 701 but also press water against the stern of power keel. 705 thus typically eliminating cavitation and vibration. When travelling forward, shrouds 702, 703, and 704 may produce a Venturi effect thus reducing fluid pressure around shrouds 702, 703, and 704.

In the present embodiment, a matched set of helical gears 706 connect a horizontal shaft 707 to a power shaft 708. Helical gears 706 may be balanced with gears polished to keep from galling up. It should be noted that all the lubricant used in the system is typically synthetic. A main bearing seal 709 may separate the sea water outside from the lubricant inside the power keel. Power keel. 705 may be made of cast steel and is machined to specifications at the machine shop. The bearing covers are made of cast steel and, when taking the machine apart or putting the machine together, the mating area/surface is the horizontal joint Two main, bearings 710 may be designed to withstand specified weight and RPM loads. Two truss bearings 711 may be mounted back to back and hold the position of the helical gears 706 so gears 706 typically remain enmeshed_ Truss bearings 711 also may stop linear floating of horizontal shaft 707. A hardened point 712 may be located between truss bearings 711 so that truss bearings may be mounted back to back to hardened. point 712. A vertical truss bearing 713 may be used to hold vertical shaft 708 and any sensory packs that may be included for monitoring the machine.

Figure 8:
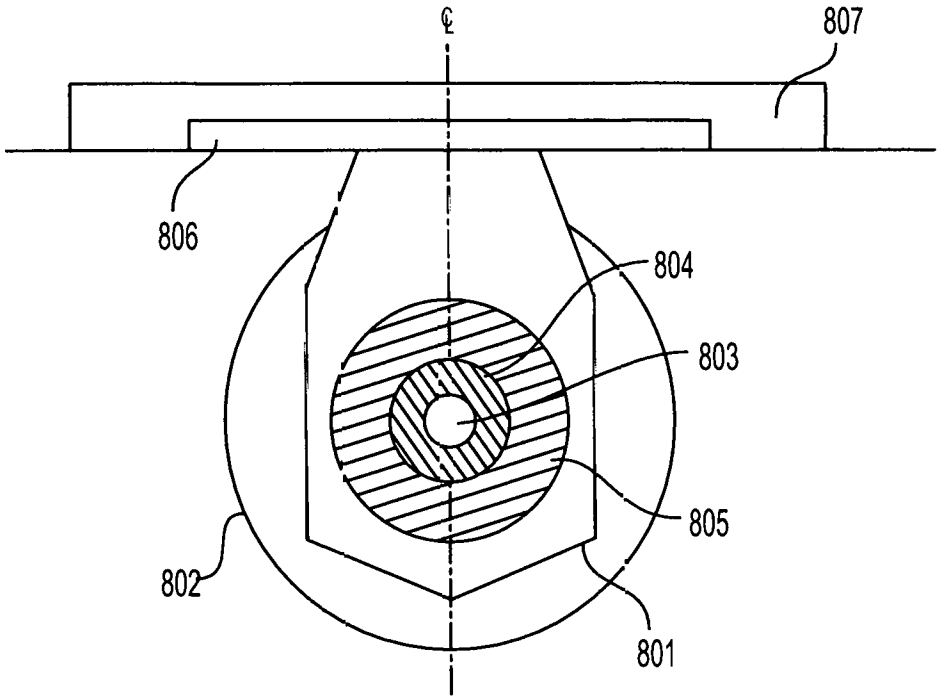
FIG. 8 illustrates a cross sectional end view of an exemplary hydro-screw pump and a keel from a bow end of a water transportation vehicle, according to an embodiment of the present invention.

FIG. 8 illustrates a cross sectional end view of an exemplary hydro-screw—a keel. 801 from a bow of a water transportation vehicle, according to an embodiment of the present invention. Power keel 801 is shown ahead of a screw 802. A main horizontal shaft 803 is concentric with all rotating parts so that horizontal shaft 803 may power these rotating parts including, but not limited to, the outside of screw 802. A main bearing 804 and truss bearings 805 are also concentric to the rest of the components, which may eliminate or lessen vibration in the system. Power keel 801 is shown with, flat walls thus showing that flat steel sheet metal can also be used. However, the power keel may also comprise rounded walls and may be configured in various different shapes in alternate embodiments. In the present embodiment, a top sole plate 806 of power keel, 801 may be connected to the water transportation vehicle by a mating sole plate 807 attached to the water transportation vehicle.

Figure 9:
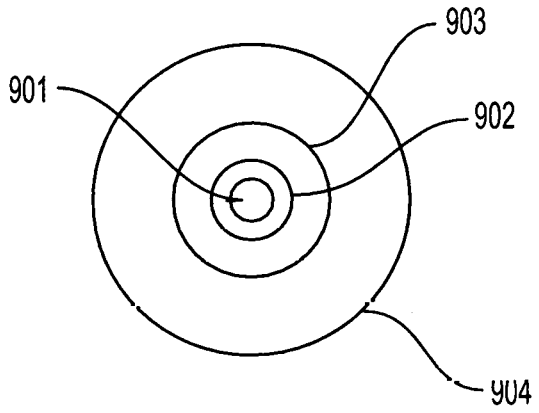
FIG. 9 illustrates a stern cross section view of an exemplary hydro propulsion drive system, in accordance with an embodiment of the present invention.

FIG. 9 illustrates a stern end view of an exemplary hydro propulsion drive system, in accordance with an embodiment of the present invention. In the present embodiment, a horizontal drive shaft 901 runs through the centers of main bearings 902, truss bearings 903, and an auger style drive screw 904. Horizontal drive shaft 901 may be turned down to a. smaller diameter where the components are to be installed and left at its maximum size where the fins or sections of screw 904 are to be welded in place.

Figure 10:
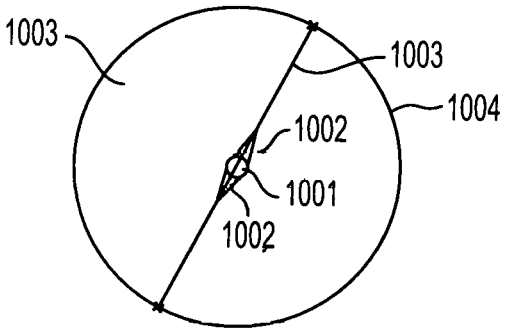
FIG. 10 illustrates a cross-sectional view of an exemplary hydro-screw as seen from the stern end of a water transportation vehicle, according to an embodiment of the present invention.

FIG. 10 illustrates a cross-sectional view of an exemplary hydro-screw as seen from the stern end of a water transportation vehicle, according to an embodiment of the present invention. In the present embodiment, a horizontal drive shaft 1001 comprises four troughs 1002 that move water and/or pressure away from the main bearing and seal of the hydro-screw. This pumps spiral with the auger turning, pumps the water/pressure away from the main bearing seal. In the present embodiment, the hydro-screw comprises two fins 1003 exactly 180 degrees apart and symmetrical for balancing. The outer-circumference 1004 of the hydro screw fins 1003 forms a full circle.

Figure 4:
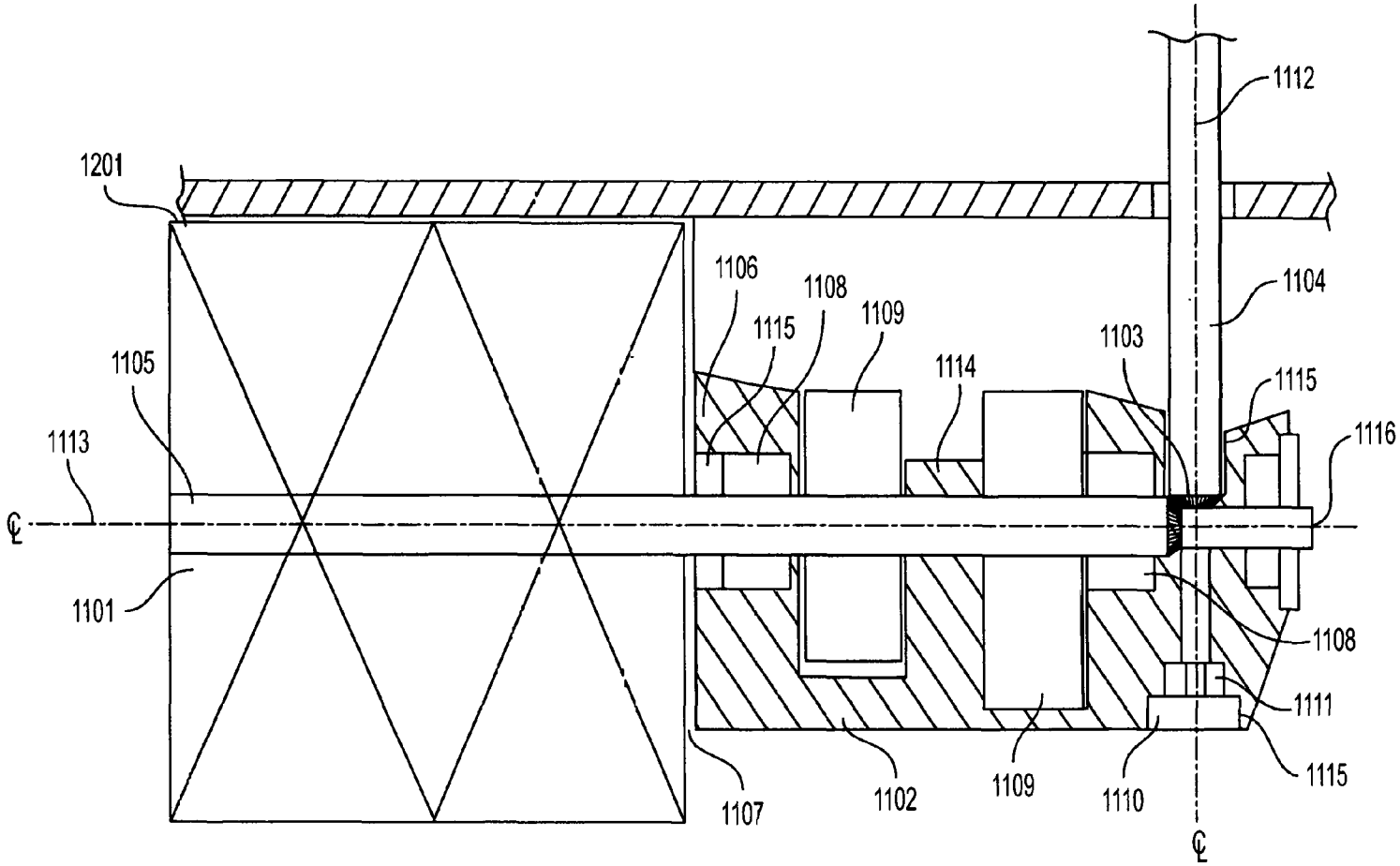
FIG. 4 illustrates a side view of the hydro propulsion system, according to an embodiment of the present invention.
Figure 11:
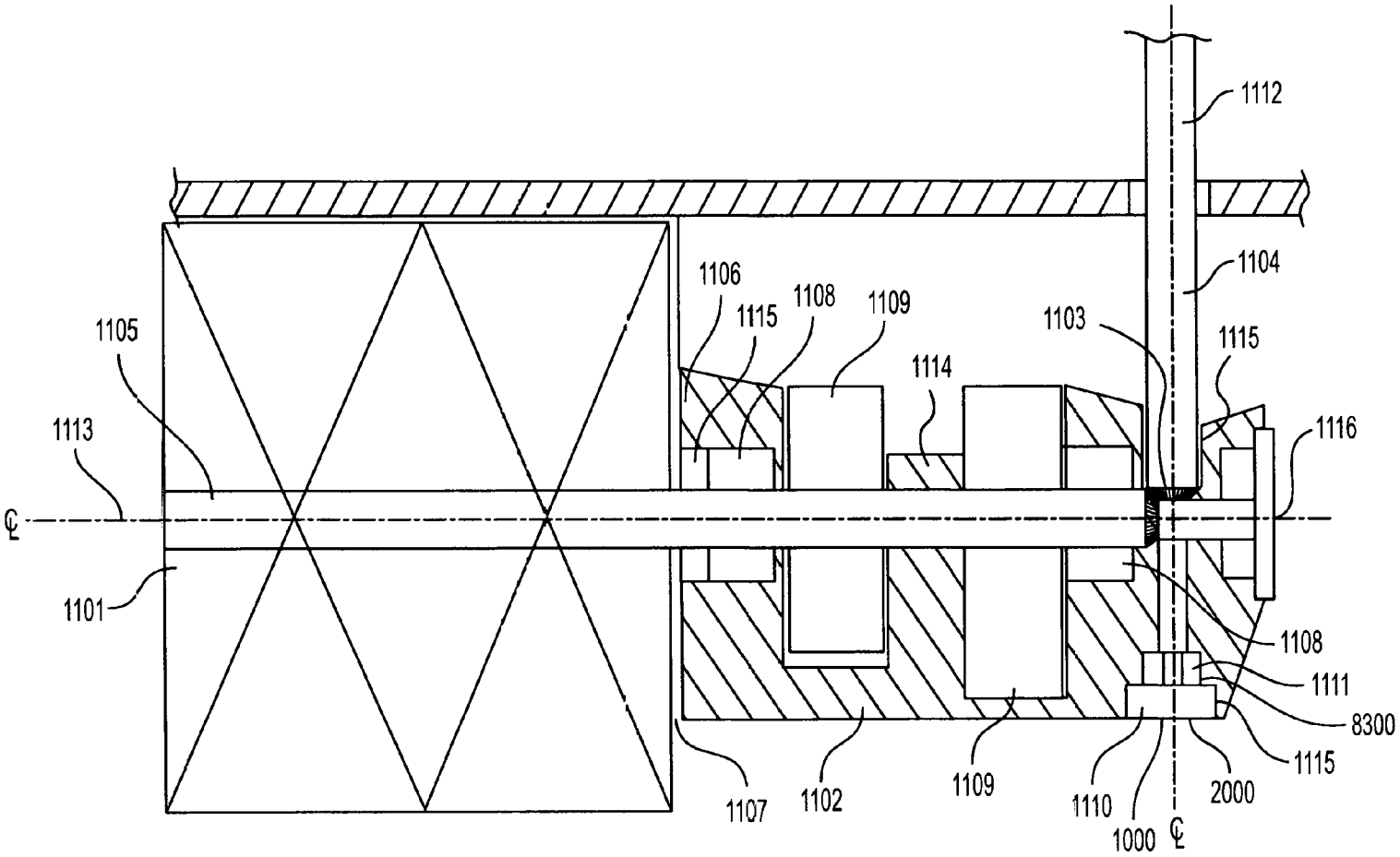
FIG. 11 illustrates a side view of the hydro propulsion system, according to an embodiment of the present invention.

FIG. 11 and FIG. 4 illustrates a side view of the hydro propulsion system, according to an embodiment of the present invention. An auger type screw 1101, a power keel 1102, and a drive train are all shown. In the present embodiment, the drive train comprises two helical gears 1103 at the ends of a power shaft 1104 and a horizontal shaft 1105. Gears 1103 may be machined into shafts 1104 and 1105 so that a gear cannot be lost due to excessive torque or vibration due to imbalance. A seal 1106 may be located at the stern end of power keel 1102. A ¾ inch air gap 1107 between power keel 1102 and screw 1101 typically allows excess water from the back pressure to the flow of the shrouds of screw 1101 and escape the system without damage to seal 1106. Main bearings 1108 are positioned as to use the entire available length of power keel 1102. Two truss bearings 1109 hold, a point of reference on horizontal shaft 1105 that does not expand or contract due to heat or the loss of heat. Helical gears 1103 should thus stay fully engaged. An inspection cover 1110 on the bottom of power keel 1102 may hold a vertical truss bearing 1111 and may be used to shim, power shaft 1004 to get proper meshing of helical gears 1003. A vertical center line 1112 may be found in this area of power keel. 1102 which may be used in building power keel 1102 and in the alignment of power shaft 1104 to the power plant on board the water transportation vehicle. A horizontal center line 1113 may be used for installing the components inside power keel 1102. In some applications in which a V-shaped bracket is to be installed on horizontal shaft 1105, center line 1113 may be used to determine where the V bracket is to be installed. Truss bearings 1109 are installed on a hardened member 1114 of power keel 1102. Sensor packs 1115 may be located at the ends of shafts 1104 and 1105 and in other areas. Sensor packs 1115 may monitor various properties such as, but no limited to, the temperature of the lubricant, the position of helical gears 1103, vibration, sound levels, and if there any metal flakes/filings within power keel 1102. A horizontal shaft inspection cover 1116 may allow for the inspection of helical. gears 1103 without separating the horizontal joint.

Figure 12:
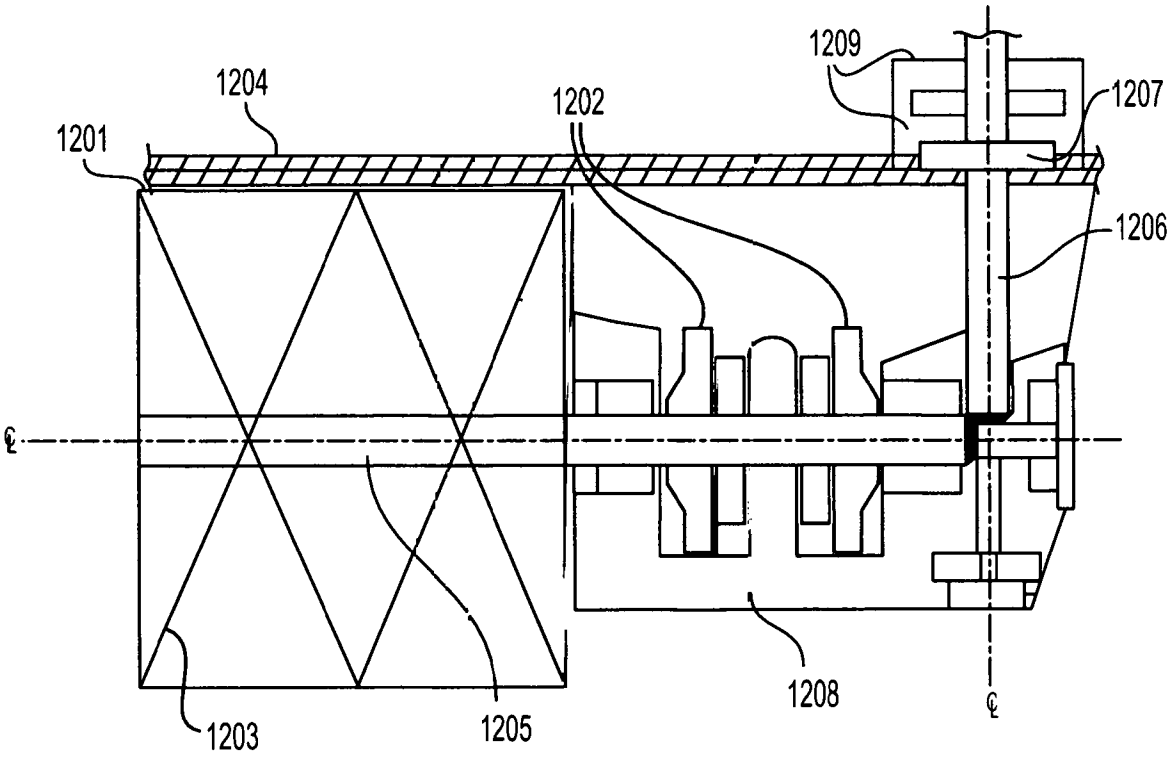
FIG. 12 illustrates a side view of the hydro propulsion system with a cutter bar and a balancing wheel, according to an embodiment of the present invention.

FIG. 12 illustrates a. side view of the hydro propulsion system with a cutter bar 1201 and a balancing wheel 1202, according to an embodiment of the present invention. In the present embodiment, cutter bar 1201 may be installed at the top dead center of a hydro screw 1203 against a sole plate 1204 and mounted in a stationary manner. As screw 1203 passes by cutter bar 1201, cutter bar 1201 cuts any debris on the screw 1203 in to pieces that may then fall away from screw 1203. At the back side of a power keel 1204 and attached to a horizontal shaft 1205 is balancing wheel. 1202 which may be used to lessen vibration by balancing the assembly of hydro screw 1203 and shaft 1205 when rotating. A vertical power shaft 1206 passes through a bearing 1207 at the top of sole plate 1204 of a power keel 1208. Two truss bearings 1209 may also be installed back to back on vertical power shaft 1206. Power shaft 1206 may connect to and. receive power from a power source/gear box of the water transportation. vehicle.

Figure 13:
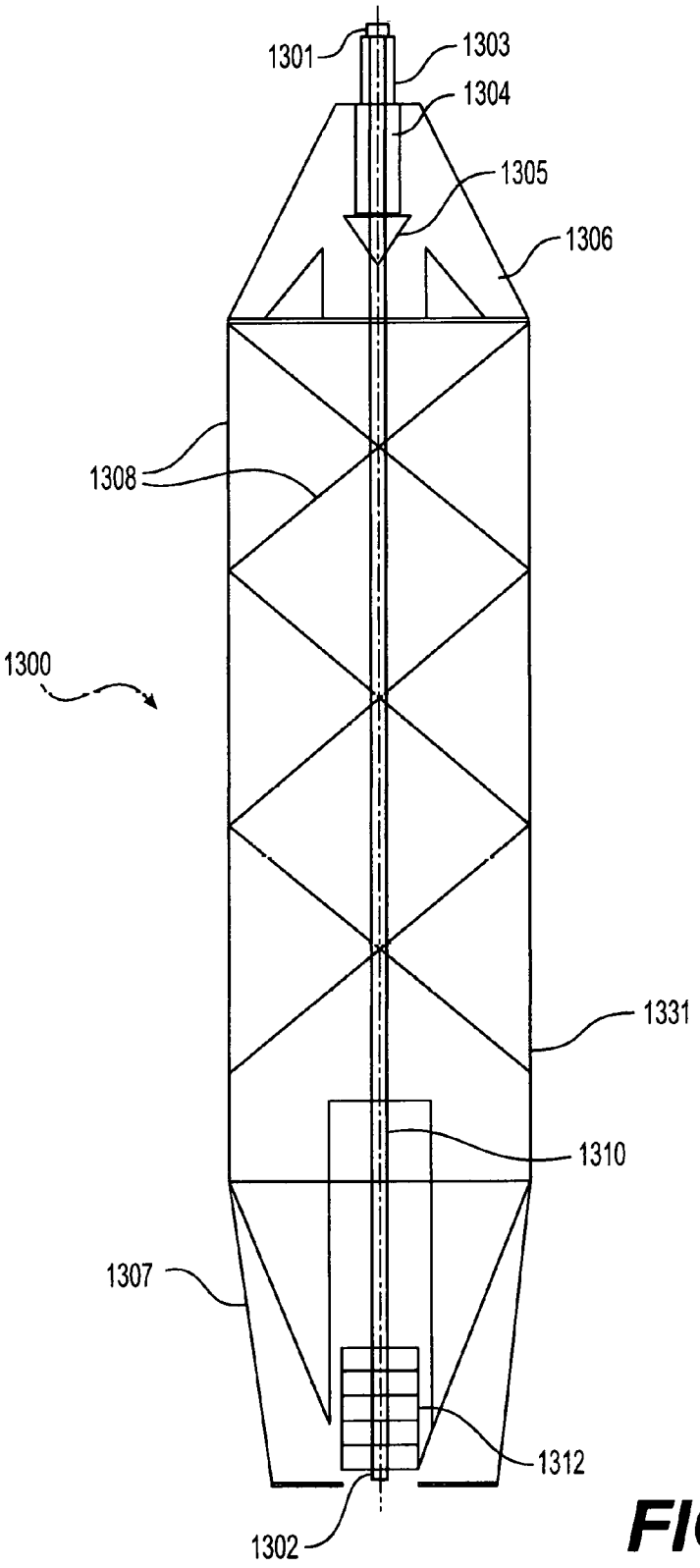
FIG. 13; illustrates a side view of the hydro system pump.

FIG. 13 illustrates a side view of an exemplary assembly of a vertical hydro-screw pump 1300, according to an embodiment of the present invention. In the present embodiment, a keeper 1301 may be fastened to the end of a central shaft 1302. Keeper 1301 may help prevent a pulley 1303 from backing off of central shaft 1302 when spinning at high RPMs. Keeper 1301 may be implemented as a bolt with an oversized head and left hand threads, which are counter rotational to the right hand threads of the fast spinning pulley 1303. Pulley 1303 may be grooved to receive a notched drive belt that may be connected to a larger pulley. Thus, with an electric motor or other power source driving the larger pulley, pulley 1303 will turn many times faster than the electric motor. In. some embodiments, the speed of the electric motor may be 3,600 RPM_ The notched drive belt may allow for zero slippage. In. the present embodiment, high speed interference fit bearings 1304 may be installed near the top of central shaft 1302. Top bearings 1304 may control the movement of the top end of central shaft 1302 and connected elements such as, but not limited to, pulley 1303. Top interference fit bearings 1304 have a bore that may be slightly smaller than. central shaft 1302, and when installed top bearings 1304 may be heated. to expand. the bore to fit onto central shaft 1302. A metal cone 1305 may be tightly fitted to central shaft 1302. Cone 1305 rotates with shaft 1302 and slings water (fluid) away from top bearing(s) 1304. A top bracket 1306 may be made as a three legged one piece cast stainless steel machined piece. A bottom bracket 1307 may also be made of stainless steel. Top bracket 1306 and bottom bracket 1307 hold. shaft 1302 and an auger style impeller 1308. The top drive pulley 1303, shaft 1302, and impeller 1308 typically hold their tolerance with. truss bearings 1304 on the top end of hydro-screw pump 1300. Top bracket 1306 supports the end play of impeller 1308, pulley 1303, and shaft 1302. Bottom bearings 1309, which. may hold impeller 1308 in alignment, are stacked against each. other and. a shoulder 1310 on shaft 1302. Shoulder 1310 assists in proper assembly. Shoulder 1310 may be created by machining shaft 1302 down to 3.750 inches for bottom. bearings 1309. This machined. in shoulder 1310 may be where bottom bearings 1309 "bottom out". The outer sleeve 1311 may be 4 feet zero inches in inside diameter with tolerances acceptable at plus or minus 0.002 of an inch. Centering bearings 1312 "float" in bottom bracket 1307 to act as centering bearings. Bottom bearings 1312 may be high, speed angular contact bearings and/or interference fit bearings.

In typical use of the present embodiment, hydro-screw pump 1300 may be used as a high volume vertical lift pump. Hydro-screw pump 1300 may be stood up on bottom bracket 1307 and placed in. water. When. pulley 1304 is powered by a larger pulley attached to a power source, impeller 1308 turns to carry water from the bottom of hydro-screw pump 1300 to the top of hydro-screw pump 1300 and out. It is believed that the ability to turn impeller 1308 at high RPMs may enable large volumes of water to be pumped. quickly. In addition, pump 1300 has high lift capabilities. Pump 1300 may be used in a multiplicity of suitable applications including, without limitation, to increase beat exchange in power plants and to flood out fires from fire boats.

Figure 14:
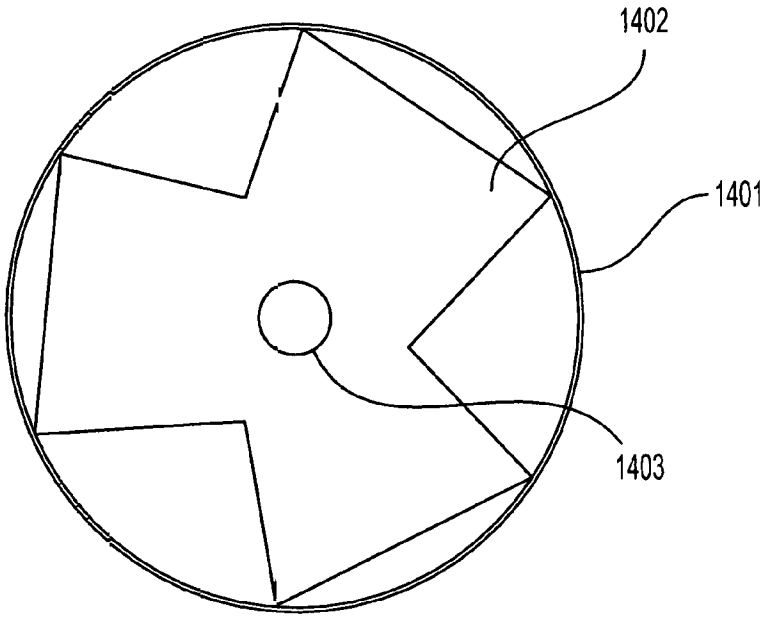
FIG. 14 illustrates a bottom view of an exemplary assembly of the hydro-screw pump, according to an embodiment of the present invention.

FIG. 14 illustrates a bottom view of an exemplary assembly of a vertical hydro-screw pump, according to an embodiment of the present invention. In the present embodiment, an outer sleeve 1401 comprises a one piece solid cast stainless steel foot 1402 with three legs having equal angles and lengths. A center hole for the central shaft is machined into foot 1402 to receive bottom bearings 1403. In the present embodiment, the diameter of the pump assembly is equal to the pitch angle or in a range of equal and double the pitch angle of the impeller, Outer sleeve 1401 has extremely close tolerances. For example, without limitation, the outside diameter (OD) of the pump assembly may be 4 ft. zero inches. Outer sleeve OD 1401 may be 4 ft. plus or minus 0.002" in diameter, while the OD of the auger style impeller may be minus 0.0005 to minus 0.0015 of an inch in diameter undersized from, the 4 foot diameter of the outer sleeve 1401. This means that the closest tolerance of the impeller to outer sleeve 1401 is 0.0015 of an inch. In the present embodiment, bottom bearings 1403 may be angular contact high speed ceramic ball bearings. These bottom bearings 1403 are typically not meant to hold the end play of the shaft. Rather, as the fluid being pumped and the pump itself heat up, bottom. bearings 1403 will bold their centers and grow lengthwise down the shaft to typically hold the pump's alignment position. It is the top bearings that typically hold the end play and truss of the impeller and top pulley, for example without limitation top bearings 1304 illustrated in FIG. 13.

In many embodiments, the power for the hydro propulsion system may come down from a ship's power plant on board. The power may be transmitted to the power keel and horizontal hydro screw via two helical. gears. These gears are part of the shafts and are machined as a matched set and are ground and polished as such to avoid gauling and helical gear and shaft gear failure. This typically allows for extremely high. RPM's without chatter or vibration. Any heat build-up inside the power keel typically does not change the helical gear settings on the shafts as they are part of the shafts. The handling of the load on the horizontal shaft is accomplished with two bearings that are interference fit to the shaft (float in the housing). These two bearings assist the truss bearings by holding the center of the horizontal shaft. In many embodiments, the truss bearings are the shoe type as built by Kings-Bury Truss Bearings. These bearings are typically mounted back to back inside the power keel and on the horizontal output shaft. The use of two ball bearing load bearings along with the two truss bearings may prevent the screw from hitting the power keel or destroying the root and clearance of the helical gears. in some cases interference fit bearings may be used. The bore of an interference fit bearing is a few thousands of an inch smaller than the shaft to which the bearing is to be installed. To install an interference fit bearing, one must heat the bearing and expand it. When the bearing is slid onto the shaft the bearing cools down and generally stays in place. The top of the power keel's shape may basically be a sole plate that covers the power keel. The power keel holds all the drive train components of the hydro propulsion system. The entire horizontal hydro systems shaft/assembly may be assembled outside of the machine in a dummy (unused) power keel. All centers are checked and rechecked without the top cover of the machine in place. After all bearings and shafts are correctly centered the horizontal shaft and assembly is installed in the new power keel and then the vertical power shaft is brought down to mesh with the other helical gear. It is believed that some embodiments may be able to power boats and ships alike beyond Mach I Some exemplary advantages of some embodiments of the present invention include, without limitation, that a ship may produce more in less time by providing a better boat drive system. The hydro screw pump and formula may be capable of high RAM's and extremely fast linear vectors. In some cases ships that use this propulsion drive system may need bow thrusters to deviate from a given set course, especially in heavily travelled shipping lanes. These benefits may be made possible may be internal workings of the power keel.

When the hydro screw starts turning, the screw makes a clean cut through the water with typically no slippage. In current approaches, screws often slip and cavitate. In the present embodiment, the pressure build up on the stern side of the power keel is relieved by the space between the power keel and the back pressure of the screw/shrouds. The pressure on the main seal between the hydro screw and the stern end of the power keel is relieved by the cork-screw shaped pump around the shaft and the fins of the hydro screw. This pressure relief may help prevent cavitation.

In some embodiments the screw may be built many times wider in its diameter than the drive shaft. The screw may be sized with a formula where the screw diameter may be 1 to 4 times the screw pitch angle. The pitch angle of the screw is typically measured in feet of travel per one revolution of the shaft not inches per one revolution. For example, without limitation, in one embodiment, the screw may be built as follows. A shaft 5" in diameter is wrapped one time in a distance of 7.5 feet by the screw. The screw is 1.5 feet in diameter. The pitch angle of the screw is 1 wrap to 7.5 feet travel. The computations are as follows: 7.5 ft.×12,000 RPM=90,000 ft. per minute; 90,000×60 minutes per hour=5, 400,000 ft. per hour; divided by 5,280 ft. per hr.=1022,72 miles per hour.

In various embodiments the screw may have several different designs. In one design the screw may comprise a standard pitch angle and one complete wrap of the auger/fin blades. In another design the screw may be a. double long screw. This design may be useful in shallow water and/or for tug boats, In yet another design the screw may comprise three shrouds to better pressurize the stern.

In some embodiments of the present invention a power keel and all of its components may be bolted to the bottom of a boat/ship. After the bolts are torqued the bold heads may be welded in place to prevent loosing/backing out due to heat from the friction of the water. The power keel is typically shaped similarly to a sail boat keel. A vertical power shaft connected to an on board engine/motor transfers power to a horizontal shaft and screw. At the bottom of the power keel is a bearing that holds the center of the power shaft. Another bearing to hold the center of the power shaft may be located at the top of the power keel. 'There may also be two truss bearings at the top of the power keel set back to back to hold the roots on the gears of an on board engine and to hold the meshing of helical gears of a horizontal drive shaft. The horizontal drive shaft may also comprise two truss bearings which hold the root of the two helical gears in the power keel. Helical gears are turned down from a 5" shaft to a 3" shaft. At the point where the 5" and 3" sections of the shaft meet on each shaft helical gears are machined in. Vibration. heat. and noise sensors may be placed throughout the power keel. The lubricant may be synthetic and sprayed on the helical gears and bearings, In some embodiments it may be useful to implement a hydro screw that is 4 feet long and 4 feet in diameter. In such basic embodiments of the invention there may be one complete turn of the shaft per one wrap (in Feet) of the shaft. This sets a hydro screw that measures RPM's in feet per minute. This screw provides maximal speed for power to the shaft; zero vibration, zero cavitation, and longer bearing life, Other embodiments may be implemented with different dimensions in which the screw design is one wrap on the shaft of a given number of feet to one expressed as a pitch angle to one times this length expressed as a diameter.

In another embodiment, the horizontal screw is designed such that it will make no sound signature. This embodiment may use a conical shaped shroud with the small end facing the stern to back feed/pressurize the stern end of the power keel.

Another embodiment may be made using stainless steel as the main shaft material to better resist rusting. It may also be desirable in some embodiments to hot weld most or all of the out board assembly to reduce further heat build-up so as to resist components pulling apart or pulling loose as at high speeds as there could be extreme damage. For example, without limitation, hot welding may be used to connect the screw shaft to the fins and shrouds of the screw of the entire outboard assembly.

Those skilled in the art will readily recognize, in light of and in accordance with the teachings of the present invention, that various embodiments of the present invention may have many benefits in different applications such as, but not limited to, racing ships/boats around the world, out running storms, hurricanes, and typhoons, to be used as a hospital ship to save lives, military uses such as, but not limited to, using the hydro-screw and pump on a submarine, to be used as a fire engine boat, and vacation. excursions. In another application, the screw pump may be placed on end vertically in a sinking ship to act as a. bilge pump All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC § 112 (1), all claims must be supported by sufficient disclosure in the present patent specification, and any material known to those skilled in the art need not be explicitly disclosed. However, 35 USC § 112 (6) requires that structures corresponding to functional limitations interpreted under 35 USC § 112 (6) must be explicitly disclosed in the patent specification. Moreover, the USPTO's Examination policy of initially treating and searching prior art under the broadest interpretation of a "mean for" claim limitation implies that the broadest initial search on 112(6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC § 112 (6) when such corresponding structures are not explicitly disclosed in the foregoing patent specification. Therefore, for any invention element(s)/structure(s) corresponding to functional claim limitation(s), in the below claims interpreted under 35 USC § 112 (6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC § 112 (6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3rd parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC § 112 (6), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC § 112 (6). Applicant(s) note that all the identified documents above which are incorporated by reference to satisfy 35 USC § 112 (6) necessarily have a filing and/or publication date prior to that of the instant application, and thus are valid prior documents to incorporated by reference in the instant application.

Having fully described at least one embodiment of the present invention, other equivalent or alternative methods of implementing a hydro-screw propulsion system according to the present invention will be apparent to those skilled in the art. Various aspects of the invention have been described above by way of illustration, and the specific embodiments disclosed are not intended to limit the invention to the particular forms disclosed. The particular implementation of the hydro-screw propulsion system may vary depending upon the particular context or application. By way of example, and not limitation, the hydro-screw propulsion systems described in the foregoing were principally directed to implementations relating to marine transportation; however, similar techniques may instead be applied to use similar systems for pumping liquids or solids for other applications such as, but not limited to, irrigation, large scale food processing, or manufacturing, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. That is, the Abstract is provided merely to introduce certain concepts and not to identify any key or essential features of the claimed subject matter. It is submitted with the understanding that it will not be used to limit or interpret the scope or meaning of the claims.

The following claims are hereby incorporated into the detailed description, with each claim standing on its own as a separate embodiment.

What is claimed is:

1. A system comprising:

a hydro screw implement;

a shaft implement that is configured to support said hydro screw implement;

a helical gear equipment disposed at a proximate end of said shaft implement, wherein said helical gear equipment is a set of helical gears configured to connect said shaft implement to a power shaft of a water vehicle;

a power keel;

a main bearing equipment housed inside said power keel, wherein said main bearing equipment is a set of main bearings configured to control a rotation and position of said shaft implement;

a truss bearing equipment, in which said truss bearing equipment comprises at least two truss bearings mounted back to back inside said power keel, wherein said at least two truss bearings are configured to control a float play of said shaft implement; and a pressure seal implement, wherein said pressure seal implement is configured to separate water or sea on one side and a power keel lubricant on the other side;

wherein a hardened point section is disposed between said at least two truss bearings, wherein said hardened point section is configured to allow said at least two truss bearings to be mounted back to back to said hardened point section.

2. The system of claim 1 further comprising a gap portion that is configured to enable water to flow around a proximate end portion of said power keel and out from said hydro screw implement, being operable for creating a pressure relief valve area around said hydro screw implement.

3. The system of claim 2, further comprising a bearing retainer and inspection cover that is operable for removal in order for maintenance to check a tolerance of said helical gear equipment.

4. The system of claim 3, in which said hydro screw implement comprises an auger type screw having a blade section.

5. The system of claim 4, further comprising a hydro trough that is configured to strengthen said shaft implement and said blade section of said auger type screw.

6. The system of claim 5, further comprising a shroud implement, wherein said shroud implement comprises at least three or more shrouds operable to eliminate vibration.

7. The system of claim 3, in which said shaft implement is configured to run through the center of said main bearing equipment, truss bearing equipment and hydro screw implement, wherein said shaft implement is a horizontal shaft implement.

8. The system of claim 3, in which said shaft implement comprises at least three or more troughs configured to move water or pressure away from said main bearing equipment.

9. The system of claim 3, in which said hydro screw implement comprises at least two fins, wherein an outer circumference of said hydro screw comprises a proximate full circle.

10. The system of claim 3, further comprising a sensor pack, wherein said sensor pack is configured to monitor at least one of a temperature of a lubricant, a position of said helical gear equipment, a vibration in said shaft implement, and any metal flakes or filings within said power keel.

11. The system of claim 3, further comprising a shaft inspection cover that is operable to allow for the inspection of said helical gear equipment.

12. The system of claim 1 in which said power keel comprises at least one of a flat sheet metal and a rounded metal.

13. The system of claim 1 in which said power keel comprises at least a top sole plate, wherein said top sole plate is configured to connect to a mating sole plate attached to the water vehicle.

14. The system of claim 13, further comprising a cutter bar, wherein said cutter bar is operable to cut any debris on said hydro screw implement into pieces.

15. The system of claim 14, further comprising a balancing wheel that is operable to lessen vibration by balancing the assembly of said hydro screw implement and said shaft implement when rotating.

16. A system comprising:

a hydro screw implement;

a shaft implement, wherein said shaft implement runs in a center portion of said hydro screw implement;

a helical gear equipment disposed at a proximate end portion of said shaft implement, wherein said helical gear equipment is a set of helical gears configured to connect said shaft implement to a power shaft of a vehicle;

a power keel;

a main bearing equipment housed inside said power keel, wherein said main bearing equipment is a set of main bearings configured to control a rotation and position of said shaft implement;

a truss bearing equipment, in which said truss bearing equipment comprises at least two truss bearings mounted back to back inside said power keel, wherein said at least two truss bearings are configured to control a float play of said shaft implement;

a pressure seal implement, wherein said pressure seal implement is configured to separate water or sea on one side and a power keel lubricant on the other side;

a gap portion, wherein said gap portion is configured to enable water to flow around a proximate end portion of said power keel and out from said hydro screw implement, being operable for creating a pressure relief valve area of said hydro screw implement, wherein a hardened point section is disposed between said at least two truss bearings, wherein said hardened point section is configured to allow said at least two truss bearings to be mounted back to back to said hardened point section.

17. The system of claim 16, in which said hydro screw implement comprises an auger type screw having a blade section.

* * * * *